US008382491B2

(12) United States Patent
Chen

(10) Patent No.: US 8,382,491 B2
(45) Date of Patent: Feb. 26, 2013

(54) ELECTRICAL CONNECTOR WITH BALANCED MOUNTING STRUCTURE

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/078,007

(22) Filed: Apr. 1, 2011

(65) Prior Publication Data

US 2012/0009825 A1 Jan. 12, 2012

(30) Foreign Application Priority Data

Jul. 8, 2010 (CN) ..... 2010 2 20251899

(51) Int. Cl.
*H01R 12/00* (2006.01)

(52) U.S. Cl. ..... 439/79; 439/660

(58) Field of Classification Search ..... 439/79, 439/660

See application file for complete search history.

(56) References Cited

U.S. PATENT DOCUMENTS

| | | | | |
|---|---|---|---|---|
| 5,591,050 | A * | 1/1997 | Sueoka | 439/607.28 |
| 6,210,236 | B1 * | 4/2001 | Kan | 439/676 |
| 6,394,851 | B1 * | 5/2002 | Paciorek | 439/668 |
| 6,832,934 | B1 | 12/2004 | Zhang | |
| 7,052,300 | B2 * | 5/2006 | Okita et al. | 439/260 |
| 2003/0236014 | A1 * | 12/2003 | Hu et al. | 439/188 |
| 2005/0059281 | A1 * | 3/2005 | Bricaud et al. | 439/188 |
| 2008/0176426 | A1 * | 7/2008 | Zhu et al. | 439/79 |

* cited by examiner

*Primary Examiner* — Gary F. Paumen

(74) *Attorney, Agent, or Firm* — Wei Te Chung; Ming Chieh Chang

(57) ABSTRACT

An electrical connector for mounting on a circuit board includes a longitudinal base and a plurality of contacts received therein. The longitudinal base includes a mating face, an assembling face opposite to the mating face for confronting with an edge of the circuit board. Each contact includes a contacting portion exploding to the mating face and a spring tail extending out of the assembling face for elastically pressing against the circuit board in a height direction perpendicular to the longitudinal direction. A retention pad is secured to the housing and comprises a pressing end for elastically pressing against the circuit board to balance pre-pressure of the spring tails to the circuit board.

17 Claims, 4 Drawing Sheets

ELECTRICAL CONNECTOR WITH BALANCED MOUNTING STRUCTURE

BACKGROUND OF THE INVENTION

1. Field of the Invention

The present invention relates generally to an electrical connector, and more particularly to an electrical connector with balanced mounting structure.

2. Description of Related Arts

As miniaturization of components forces electrical connections to become more densely spaced, high density electrical connectors in stacked or combed type are frequently required and developed. A combed electrical connector is disclosed in U.S. Pat. No. 6,832,934 issued to George Huanyi Zhang on Dec. 21, 2004. Said electrical connector comprises an elongated housing defining a base portion, a SATA receiving portion and a jumper receiving portion protruded forward from a front face of the base portion. A plurality of SATA (Serial Advanced Technology Attachment) contacts and jumper contacts with SATA and jumper spring tails are received in the SATA and jumper receiving portions of the housing respectively. Both of the SATA and jumper spring tails are protruded backward from a back face for pre-contacting corresponding conductive elements of the circuit board before welding. However, the SATA contact is in a plate shape and the jumper contact is in a column shape which has better self-strength and more pressure to the board than SATA contact such that the unbalanced pre-pressure could cause deformation of the housing and reduce the welding quality. By the way, a single connector can also cause unbalanced mounting structure because of uneven contact density and so on.

Hence, an electrical connector with balanced mounting structure is desired.

SUMMARY OF THE INVENTION

Accordingly, an object of the present invention is to provide an electrical connector with balanced mounting structure.

To achieve the above object, an electrical connector for mounting on a circuit board includes a longitudinal base and a plurality of contacts received therein. The longitudinal base includes a mating face, an assembling face opposite to the mating face for confronting with an edge of the circuit board. Each contact includes a contacting portion exploding to the mating face and a spring tail extending out of the assembling face for elastically pressing against the circuit board in a height direction perpendicular to the longitudinal direction. A retention pad is secured to the housing and comprises a pressing end for elastically pressing against the circuit board to balance prepressure of the spring tails to the circuit board.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
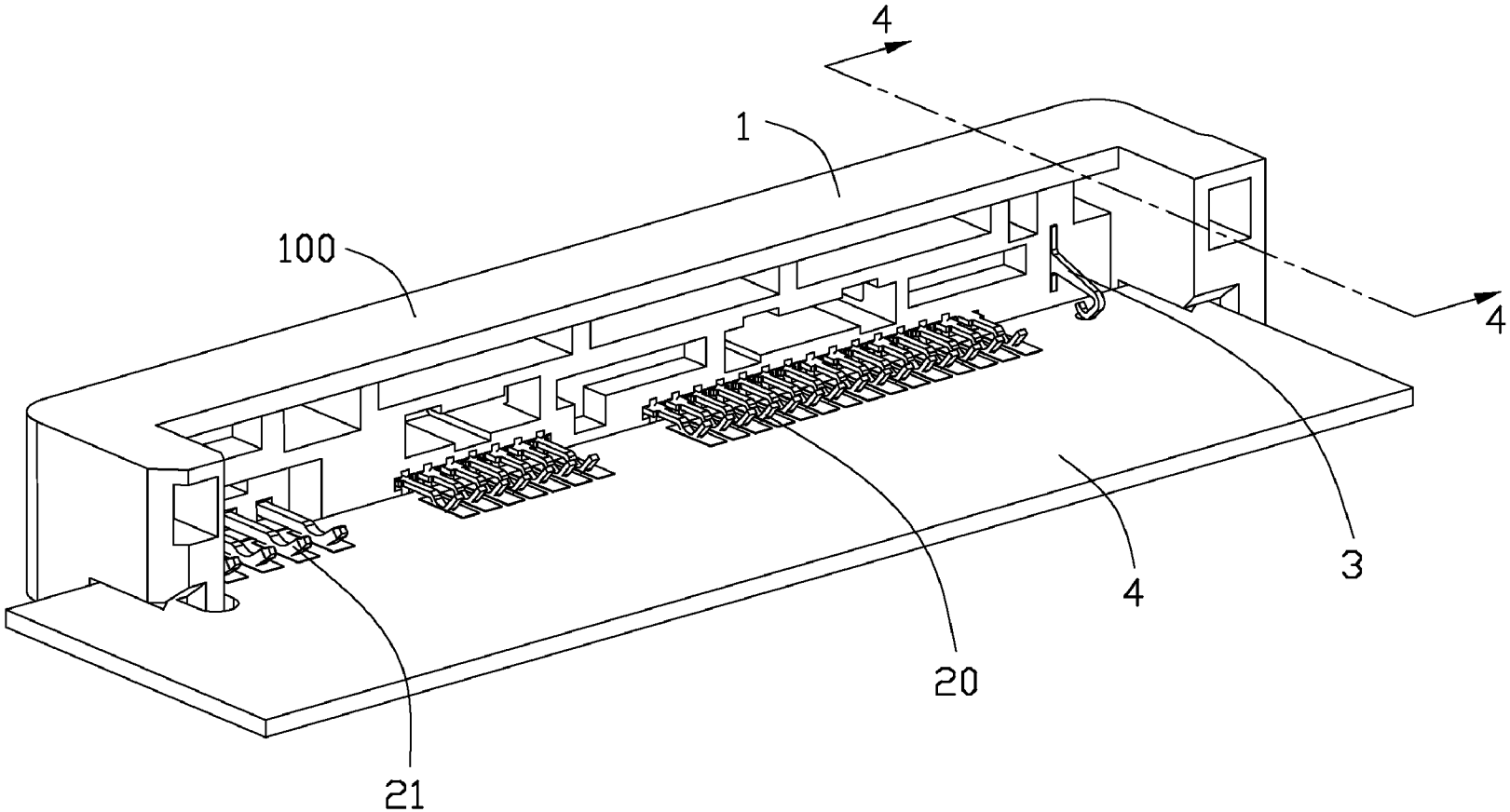
FIG. 1 is a perspective view of an electrical connector assembled with a circuit board in accordance with the present invention.
Figure 2:
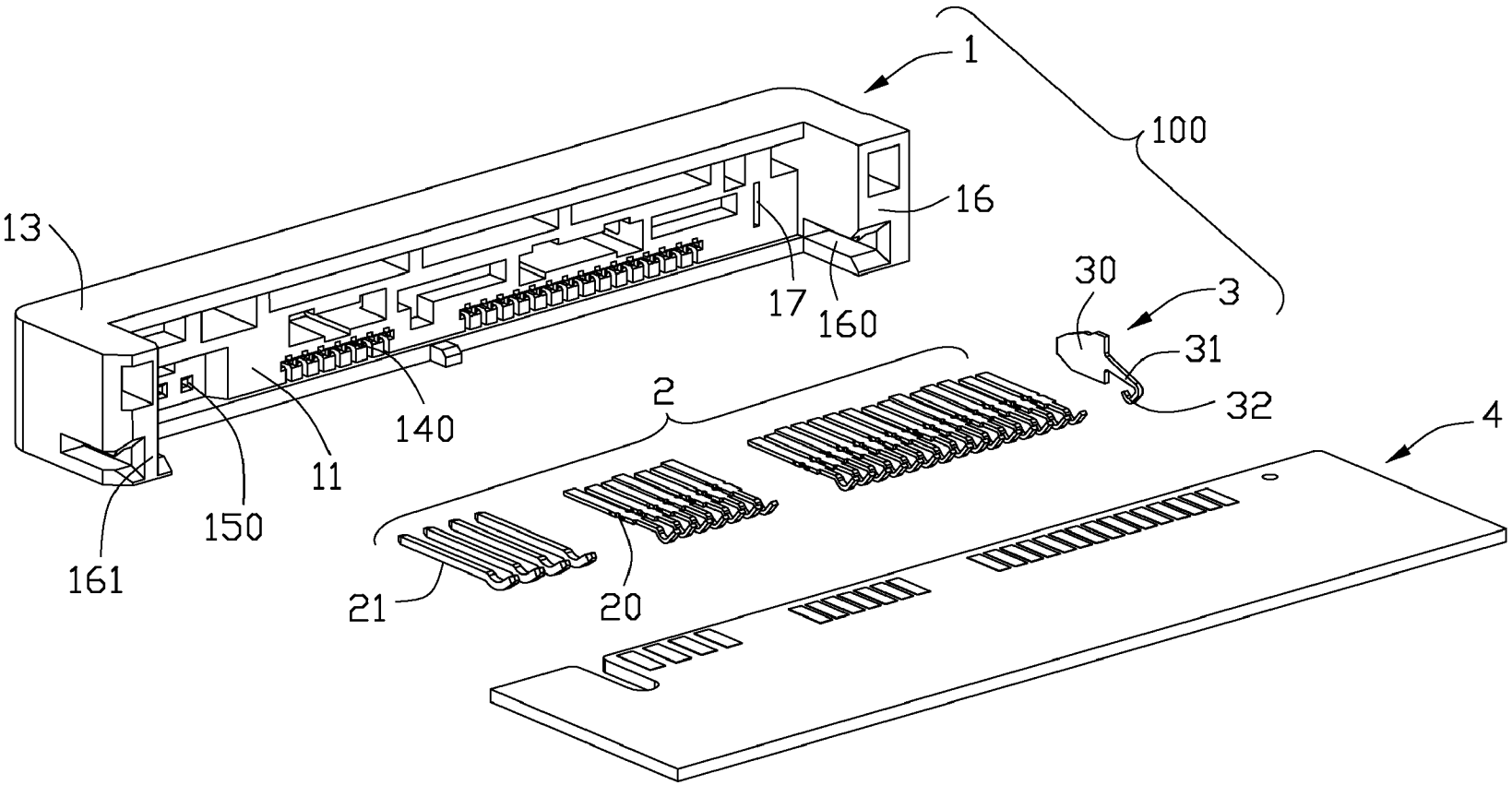
FIG. 2 is a perspective, exploded view of the electrical connector of FIG. 1.
Figure 3:
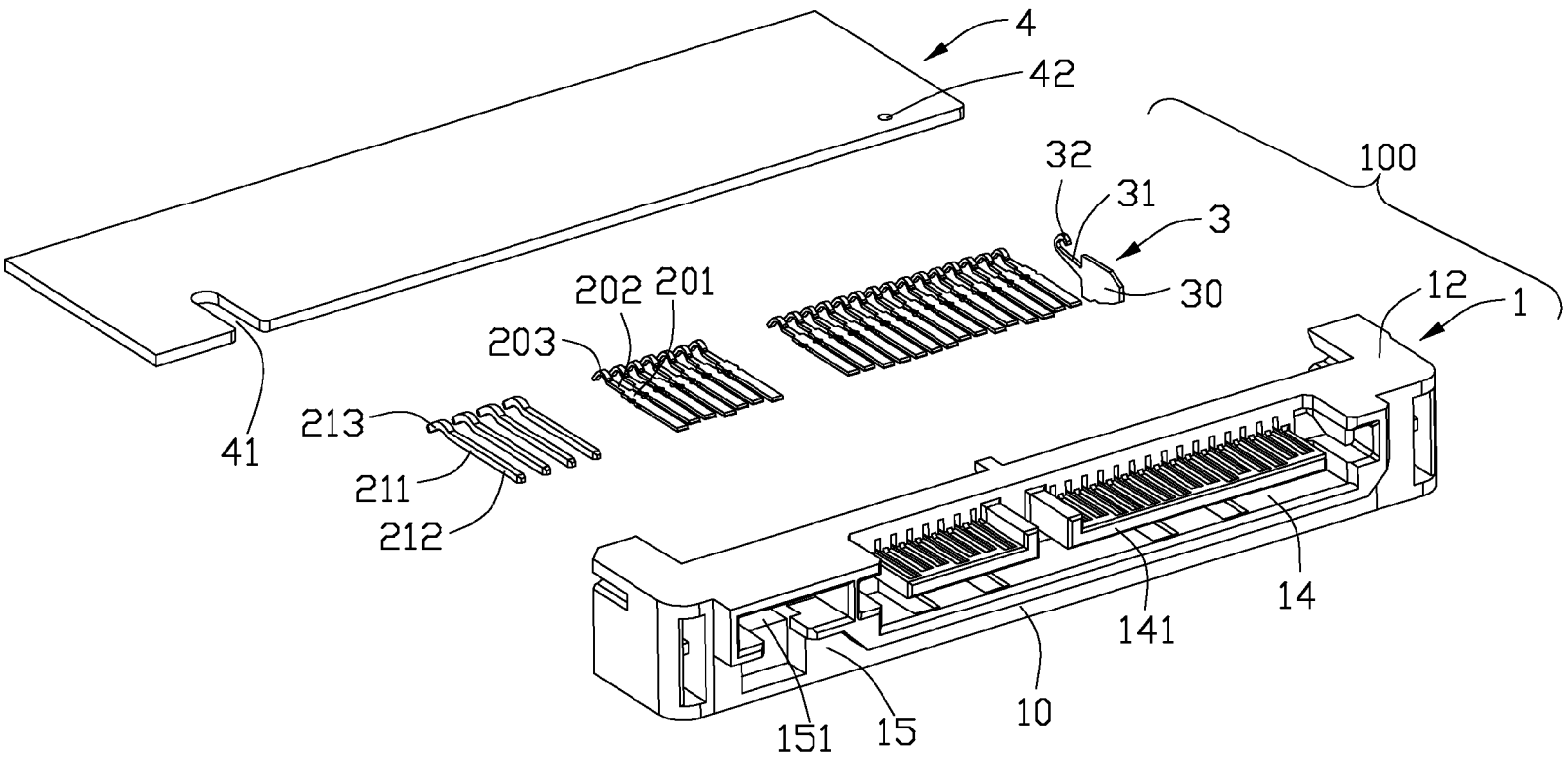
FIG. 3 is another perspective, exploded view of the electrical connector of FIG. 1.

Referring to FIGS. 1-3, an electrical connector 100 according to the preferred embodiment of the present invention is adapted for mounting on a print circuit board 4. The electrical connector 100 comprises an elongated housing 1, a plurality of contacts 2 (including first contacts 20 and second contacts 21) and a retention pad 3 disposed in the housing 1.

The elongated housing 1 defines a mating face 10, a assembling face 11 opposite to the mating face, a top face 12 perpendicularly to the mating face 10 and a bottom face 13 opposite to the top face 10. The elongated housing 1 includes a first accommodating portion 14 acting as a SATA connector and a second accommodating portion 15 as a jumper connector. The first and the second accommodating portion are arranged side-by-side along a longitudinal direction. The first accommodating portion 14 and the second accommodating portion 15 respectively define a plurality of first and second receiving passageways 140, 150 configured with the first and second contacts 20, 21. The first accommodating portion 14 comprises two L shaped tongue portion 141 and the second accommodating portion 15 forms a receiving cavity 151 for receiving a complementary connector (not shown). A pair of retaining portions 16 are protruded at two elongated side of the housing from the assembling face 11 and each retaining portion 16 forms a board retaining slot 160. One of the retaining slots 160 is covering a board edge of the circuit board and the other forms a board retaining rib 161 to mate with a slot 41 of the board to secure with the board 4. The retention pad 3 is located on the outer side near the first accommodating portion 15 and a corresponding recess 17 perpendicular to the longitudinal direction is formed on the circuit board 4 to secure with the retention pad 3.

Figure 4:
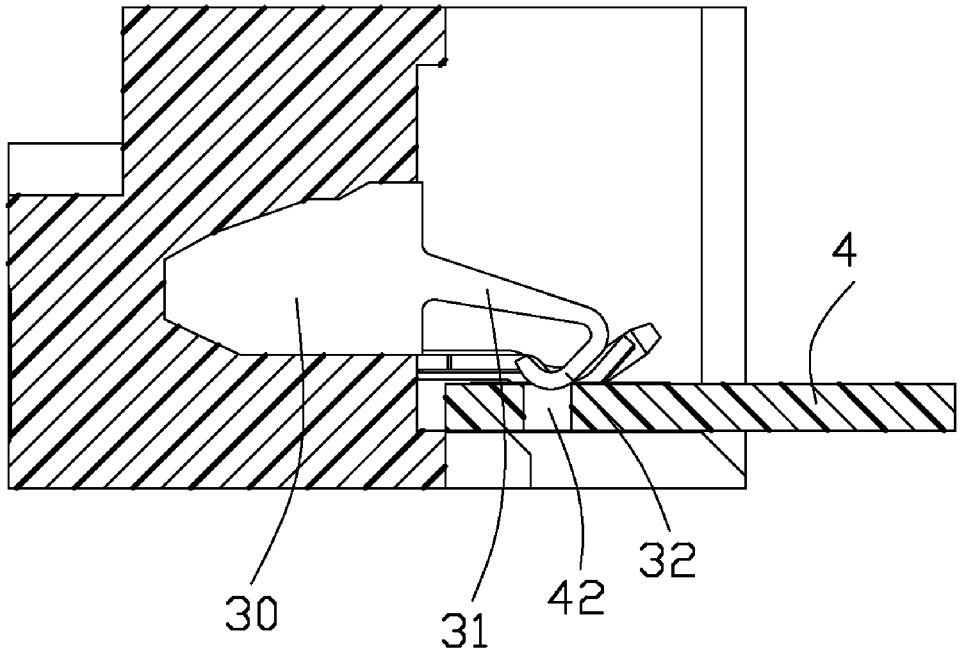
FIG. 4 is a cross section view of the electrical connector taken along a broken line 4-4 in FIG. 1.

Referring to FIGS. 2-4, the thickness of the second contacts 20 is larger than that of the first contacts 21 in an up and down direction. Each first contact 20 comprises a first retaining portion 201, a first spring arm 202 extending from one end of the retaining portion 201, a first spring tail 203 formed on the free end of the first spring arm 202 and a first contacting portion (not labeled) extending on the other end of the retaining portion 201 and disposed on both L shaped tongue portions 141. The second contact 21 comprises a second retaining portion 211 received in the second receiving passageways 150, a second contacting portion 212 and a second spring tail 213 extending from opposite ends of the second retaining portion 211. The normal section of the second contact 21 is a square with sides of 0.64 mm which is a standard mating width.

Referring particularly to FIGS. 2 and 4, the retention pad 3 comprises a retaining base 30 for being engaged in the recess 17 of the housing, an arm section 31 extending from the retaining base 30 and protruding out of the assembling face 11 and a pressing end 32 turning back from free end of the arm section 31 and elastically protruding towards a through hole 42 formed on the circuit board 4. The board projecting length of the pressing end 32 is longer than the diameter of the through hole 42 to keep a stable locating function.

In assembly, the circuit board 4 is moved from the side of the assembling face 11 of the electrical connector 100, with the elongate board edge engaging with the retaining slots 160 of the electrical connector 100, the first and second spring tails 203, 213 of the first and second contacts 20, 21 elastically pre-contact with conductive elements of the circuit board 4 and the pressing end 32 of the retention pad 3 presses into the through hole 42. The force that the retention pad 3 applied can regulate according to the force gap between the first and second contacts. Thus, the stress taken to the electrical connector 100 can easily be balanced after board assembling to avoid housing deformation and ensure the welding quality after soldering. In any other embodiment, the force gap may also be caused by uneven contact density and so on.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector for mounting on a circuit board, comprising:

a longitudinal base comprising a mating face, an assembling face opposite to the mating face for confronting with an edge of the circuit board;

a plurality of contacts received in the longitudinal base along a longitudinal direction, each contact comprising a contacting portion exposed to the mating face and a spring tail extending out of the assembling face for elastically pressing against the circuit board in a height direction perpendicular to the longitudinal direction;

wherein a retention pad is secured to the housing and comprises a pressing end for elastically pressing against the circuit board to balance prepressure of the spring tails to the circuit board.

2. The electrical connector as claimed in claim 1, wherein the contacts comprise a number of first and second contacts arranged side by side along the longitudinal direction, the second contacts are larger than the first contacts in dimension along the height direction and the retention pad is adjacent to one side of the first contacts opposite to the second contacts along the longitudinal direction.

3. The electrical connector as claimed in claim 1, wherein the retention pad comprises a retaining base retained in the housing and an arm section extending away from the assembling face, the pressing end bends from a free end of the arm section.

4. The electrical connector as claimed in claim 1, wherein the first contacts are in plate shape, the second contacts are in column shape which are stronger than the first contacts.

5. The electrical connector as claimed in claim 1, wherein the housing defines a pair of retaining portions with board retaining slot for receiving and retaining lateral sides of the circuit board.

6. The electrical connector as claimed in claim 5, wherein a board retaining rib is formed on the retaining slot along the height direction.

7. The electrical connector as claimed in claim 6, wherein the pressing end is pressed against a locating hole defined on the circuit board and a board projecting length of the pressing end is larger than a diameter of the through hole.

8. An electrical connector for mounting with a circuit board, comprising:

two mating ports arranged side by side along a longitudinal direction thereof;

one of said two mating ports comprising a tongue portion and a plurality of first contacts, the first contacts comprising contacting portions embedded in the tongue portion and exposed to one surface of the tongue portion and spring tails exposed to a rear face of the connector;

the other one of said two mating ports comprising a mating cavity and a plurality of second contacts, the second contacts comprising pin shaped contacting portions accommodating in the mating cavity and spring tails exposed to the rear face of the connector;

the electrical connector further comprising a balanced mounting structure retained beside said one of the two mating ports and spaced away from said the other one of the two mating ports; wherein the balanced mounting structure is made of sheet metal and comprises a spring arm for pressing against the circuit board; wherein both the first contacts and the balanced mounting structure are made of sheet metal and a sheet surface of the sheet metal is disposed perpendicular to that of the first contacts; wherein the spring arm of the balanced mounting structure is extending away from the assembling face and a pressing end is turning back toward the assembling face from the free end of the arm section.

9. An electrical connector assembly comprising:

an electrical connector including:

an insulative housing defining a front mating port and a rear mounting port in a front-to-back direction;

a plurality of contacts disposed in the housing along a lengthwise direction perpendicular to said front-to-back direction, each of said contacts including a front mating section exposed in the front mating port and a rear mounting section exposed in the rear mounting port; and a pair of retaining slots formed around the rear mounting section to receive a printed circuit board therein; wherein the rear mounting sections of all said contacts are connected to the printed circuit board and arranged in an asymmetric manner along said lengthwise direction, and the housing is equipped with a retention pad around a specific position of the housing in said lengthwise direction under condition that said retention pad applies an additional force upon the printed circuit board to counterbalance existing forces upon the printed circuit board which are derived from the contacting sections of the contacts.

10. The electrical connector assembly as claimed in claim 9, wherein the force applied to the printed circuit board and derived from the mounting sections of the contacts defines a force direction same with that defined by the force derived from the retention pad.

11. The electrical connector assembly as claimed in claim 9, wherein said retention pad is located around a lengthwise end of the housing.

12. The electrical connector assembly as claimed in claim 11, wherein there is only one of said retention pad around the corresponding lengthwise end and the other lengthwise end is not equipped with said retention pad.

13. The electrical connector assembly as claimed in claim 9, wherein the printed circuit board defines a hole, and the retention pad defines a protrusion at a free end retained in the hole.

14. The electrical connector assembly as claimed in claim 9, wherein the contacts are categorized with thick ones and thin ones, and the retention pad is located beside the thin ones while relative far away from the thick ones.

15. The electrical connector assembly as claimed in claim 9, wherein the mounting sections of the contacts are soldered to the printed circuit board while the retention pad is not.

16. The electrical connector assembly as claimed in claim 9, wherein the contacting section of the contact defines a thickness direction which is parallel to a force direction derived from the contacting section and applied to the printed circuit board while the retention pad defines another thickness direction which is perpendicular to the a force direction derived from the retention pad and applied to the printed circuit board.

17. The electrical connector assembly as claimed in claim 9, wherein said housing defines a board retention rib received in a notch of the printed circuit board for guiding insertion of the printed circuit board into the retaining slots.

* * * * *